US011521452B2

(12) United States Patent
Soma

(10) Patent No.: US 11,521,452 B2
(45) Date of Patent: Dec. 6, 2022

(54) MONEY HANDLING MACHINE AND MONEY HANDLING METHOD

(71) Applicant: GLORY LTD., Hyogo (JP)

(72) Inventor: Nobuhiko Soma, Himeji (JP)

(73) Assignee: GLORY LTD., Hyogo (JP)

( * ) Notice: Subject to any disclaimer, the term of this patent is extended or adjusted under 35 U.S.C. 154(b) by 335 days.

(21) Appl. No.: 16/467,182

(22) PCT Filed: Nov. 17, 2017

(86) PCT No.: PCT/JP2017/041546
§ 371 (c)(1),
(2) Date: Jun. 6, 2019

(87) PCT Pub. No.: WO2018/110208
PCT Pub. Date: Jun. 21, 2018

(65) Prior Publication Data

US 2020/0020190 A1 Jan. 16, 2020

(30) Foreign Application Priority Data

Dec. 14, 2016 (JP) ..... JP2016-242237

(51) Int. Cl.
*G07D 9/00* (2006.01)
*G07D 9/02* (2006.01)
(Continued)

(52) U.S. Cl.
CPC ..... *G07D 9/008* (2013.01); *G07C 9/32* (2020.01); *G07D 9/002* (2013.01); *G07D 9/02* (2013.01);
(Continued)

(58) Field of Classification Search
CPC ..... G07D 9/008; G07D 9/002; G07D 9/02; G07D 11/26; G07D 11/235; G07D 11/237;
(Continued)

(56) References Cited

U.S. PATENT DOCUMENTS 5,451,757 A * 9/1995 Heath, Jr. ..... G07C 9/33 340/5.4
8,157,078 B1 * 4/2012 Folk ..... G07D 11/235 194/206
(Continued)

FOREIGN PATENT DOCUMENTS

EP 1531432 A2 5/2005
JP 2009-145929 A 7/2009
(Continued)

OTHER PUBLICATIONS

International Search Report issued in International Patent Application No. PCT/JP2017/041546, dated Feb. 20, 2018, and English translation thereof.
(Continued)

*Primary Examiner* — Jeffrey A Shapiro
(74) *Attorney, Agent, or Firm* — Greenblum & Bernstein, P.L.C.

(57) ABSTRACT

A money handling machine includes: a housing; a drawer that is drawable from the housing; a locking mechanism configured to lock the drawer in the housing; an identification information acquisition unit configured to acquire identification information of an operator; and a controller configured to control the locking mechanism such that, when an error occurs in a handling unit, the drawer can be drawn from the housing subject to the identification information of the operator having been acquired by the identification information acquisition unit.

15 Claims, 8 Drawing Sheets

(51) Int. Cl.

| | |
|---|---|
| ***G07C 9/32*** | (2020.01) |
| ***G07D 11/235*** | (2019.01) |
| ***G07D 11/237*** | (2019.01) |
| ***G07D 11/26*** | (2019.01) |
| ***G07D 11/36*** | (2019.01) |
| ***G07D 11/22*** | (2019.01) |

(52) U.S. Cl.
CPC ..... *G07D 11/22* (2019.01); *G07D 11/235* (2019.01); *G07D 11/237* (2019.01); *G07D 11/26* (2019.01); *G07D 11/36* (2019.01); *B65H 2701/1912* (2013.01)

(58) Field of Classification Search
CPC ..... G07D 11/36; G07D 11/22; B65H 2701/1912; G07C 9/32
See application file for complete search history.

(56) References Cited

U.S. PATENT DOCUMENTS

| | | | | |
|---|---|---|---|---|
| 9,908,151 | B2 * | 3/2018 | Dopfer | G07D 11/40 |
| 2002/0080030 | A1 * | 6/2002 | Inomata | G07F 17/0014 340/542 |
| 2004/0046015 | A1 * | 3/2004 | Skinner | G07D 11/235 235/379 |
| 2008/0082207 | A1 * | 4/2008 | Sjostrom | G07D 9/02 700/231 |
| 2009/0293424 | A1 * | 12/2009 | Mori | G07D 11/10 53/167 |
| 2010/0025183 | A1 * | 2/2010 | Folk | G07D 11/25 194/200 |
| 2010/0066491 | A1 * | 3/2010 | Bohen | G07D 11/125 340/5.51 |
| 2011/0120015 | A1 * | 5/2011 | Schmidt | G07D 11/237 49/31 |
| 2012/0012437 | A1 * | 1/2012 | Matsumoto | G07D 11/60 194/342 |
| 2013/0048715 | A1 * | 2/2013 | Cardinal | E05G 1/024 235/379 |
| 2013/0205723 | A1 * | 8/2013 | Blake | G07D 9/00 53/473 |
| 2016/0260295 | A1 * | 9/2016 | Dent | G06Q 20/401 |

FOREIGN PATENT DOCUMENTS

| | | | |
|---|---|---|---|
| JP | 2014-081851 | A | 5/2014 |
| JP | 2015-162121 | A | 9/2015 |
| JP | 2016-71661 | A | 5/2016 |
| JP | 2016-095674 | A | 5/2016 |
| JP | 2016-146059 | A | 8/2016 |

OTHER PUBLICATIONS

Extended European Search Report dated Jun. 8, 2020 issued in application No. 17880191.6-1009.

Japanese Office Action dated Jul. 21, 2020 issued in Japanese Patent Application No. 2016-242237, and corresponding English translation.

* cited by examiner

MONEY HANDLING MACHINE AND MONEY HANDLING METHOD

TECHNICAL FIELD

The present invention relates to a money handling machine that handles money such as banknotes and coins, and a money handling method performed by the money handling machine.

BACKGROUND ART

In a money handling machine that handles money such as banknotes and coins, for example, when an error such as jamming of money occurs in a transport unit in a housing, a guidance screen for a procedure of a restoring operation is displayed on a display unit such as a monitor or a touch panel. An operator removes money that has caused the jamming, according to the guidance screen displayed on the display unit. Specifically, when the error occurs, a drawer having the transport unit and the like disposed therein can be drawn from the housing. The operator draws the drawer from the housing, and thereafter removes the money from the transport unit and the like in the drawer, thereby resolving the error. More specifically, in a case where the drawer is returned into the housing after removal of the money from the transport unit and the like in the drawer which has been drawn from the housing, when the error is determined to have been resolved, the money handling machine is restored to a normal state. Meanwhile, when the drawer having been drawn from the housing is returned into the housing, if it is determined that the error has not been resolved, the guidance screen indicating that the error still occurs, is displayed on the display unit. In this case, the drawer is maintained so as to be drawable from the housing, whereby the operator draws again the drawer from the housing, so as to resolve the error.

Furthermore, Japanese Laid-Open Patent Publication No. 2016-71661 discloses an apparatus that switches and displays, for each region, a guidance screen for drawing a drawer from a housing and removing money from the drawer when the error occurs, and omits display of the guidance screen for the region in which the operation is detected to have been already performed.

SUMMARY OF THE INVENTION

In the money handling machine, in a case where any person is allowed to draw a drawer from a housing if the error occurs, when the operator (for example, a clerk of a store) having the authority to resolve the error departs from the money handling machine, a third party may draw the drawer from the housing without permission, and take away money from the drawer.

The present invention has been made in view of such circumstances, and an object of the present invention is to provide a money handling machine and a money handling method that allow a drawer to be drawn from a housing, subject to identification information of an operator having been acquired by an identification information acquisition unit, when an error occurs in a handling unit, to prevent a third party from drawing the drawer from the housing without permission and taking away money from the drawer.

A money handling machine of the present invention comprises a housing; a drawer configured to have a handling unit for handling money, and configured to be drawable from the housing; a locking mechanism configured to lock the drawer in the housing; an identification information acquisition unit configured to acquire identification information of an operator; and a controller configured to control the locking mechanism such that, when an error occurs in the handling unit, the drawer can be drawn from the housing subject to the identification information of the operator having been acquired by the identification information acquisition unit.

The money handling machine of the present invention may further comprise a memory configured to store identification information of an authorized operator who is authorized to resolve the error as stored identification information, and the controller may control the locking mechanism such that, when the error occurs in the handling unit, the drawer can be drawn from the housing only when acquired identification information by the identification information acquisition unit matches the stored identification information in the memory.

In the money handling machine of the present invention, the controller may control the locking mechanism such that, if the drawer has been returned into the housing before resolving of the error occurring in the handling unit is completed, the drawer can be drawn again from the housing only when predetermined identification information has been acquired by the identification information acquisition unit.

In this case, the predetermined identification information may be identification information of the operator acquired by the identification information acquisition unit for the first time after occurrence of the error in the handling unit.

The money handling machine of the present invention may further comprise a display unit configured to display an indicator for prompting acquisition of identification information of the operator by the identification information acquisition unit when the error has occurred in the handling unit.

In this case, when the drawer has been returned into the housing before resolving of the error occurring in the handling unit is completed, the display unit may display the indicator for prompting identification information of the operator to be acquired again by the identification information acquisition unit.

The money handling machine of the present invention may further comprise a human detection unit configured to detect whether or not the operator is near the housing.

In this case, if the error occurs in the handling unit and the human detection unit detects that the operator is not near the housing, the controller may cause the identification information acquisition unit to acquire identification information of the operator when the human detection unit detects that the operator is again near the housing until resolving of the error occurring in the handling unit is completed.

In addition, the money handling machine of the present invention may further comprise a notification unit configured to provide notification that the operator is not near the housing if the human detection unit detects that the operator is not near the housing when the error has occurred in the handling unit.

A money handling method of the present invention performed by a money handling machine comprising a drawer configured to have a handling unit for handling money, and configured to be drawable from a housing, and an identification information acquisition unit configured to acquire identification information of an operator, the money handling method comprising: locking the drawer in the housing; and causing the drawer to be drawable from the housing subject to the identification information of the operator having been acquired by the identification information acquisition unit when an error occurs in the handling unit.

The money handling method of the present invention may further comprise storing, in a memory, identification information of an authorized operator who is authorized to resolve the error as stored identification information, and the drawer can be drawn from the housing only when acquired identification information by the identification information acquisition unit matches the stored identification information in the memory when the error occurs in the handling unit.

In the money handling method of the present invention, if the drawer has been returned into the housing before resolving of the error occurring in the handling unit is completed, the drawer can be drawn again from the housing only when predetermined identification information has been acquired by the identification information acquisition unit.

DESCRIPTION OF THE PREFERRED EMBODIMENTS

Figure 1:
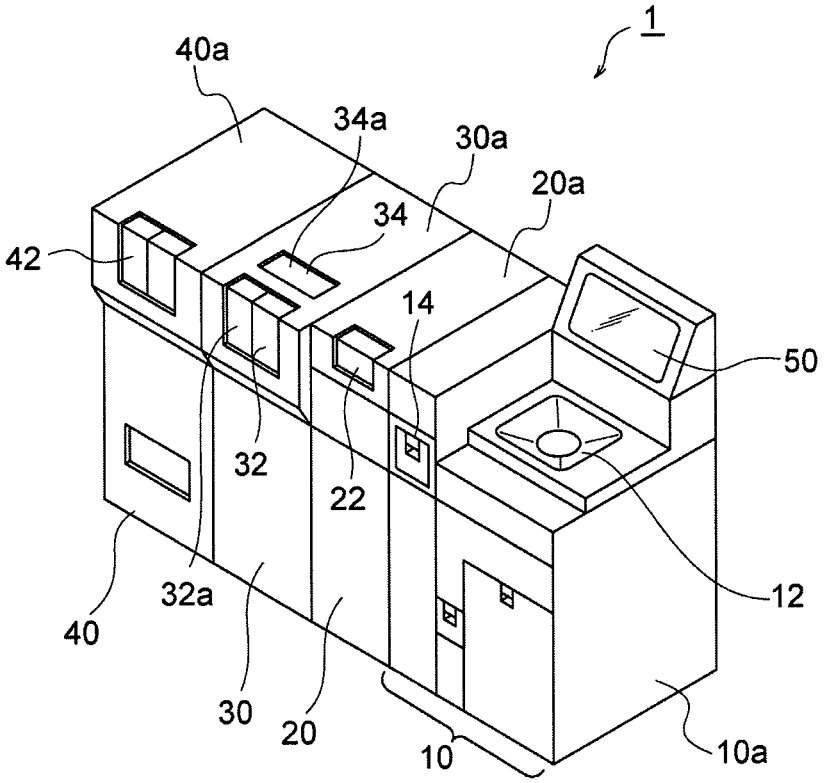
FIG. 1 is a perspective view of an outer appearance of a money handling machine according to an embodiment of the present invention.

Firstly, a configuration of a money handling machine 1 having a loose-banknotes handling assembly 30 according to the present embodiment will be described with reference to FIG. 1. As shown in FIG. 1, the money handling machine 1 includes a loose-coins handling assembly 10 that handles loose coins, a coin roll handling assembly 20 that handles coin rolls, the loose-banknotes handling assembly 30 that handles loose banknotes, and a bound-banknotes handling assembly 40 that handles bound banknotes.

As shown in FIG. 1, a loose-coins inlet 12 is disposed in the upper surface of the loose-coins handling assembly 10. Loose coins inserted in the loose-coins inlet 12 are fed out into a machine of the loose-coins handling assembly 10, and a recognition unit (not shown) in the machine of the loose-coins handling assembly 10 performs recognition of a denomination, authentication, fitness, new/old, and the like of the coins. Thereafter, the coins are stored, for example, for each denomination, in a plurality of loose-coins storage units (not shown) in the machine of the loose-coins handling assembly 10. A loose-coins outlet 14 is disposed in the front surface of the loose-coins handling assembly 10. When an instruction for dispensing loose coins is issued to a controller 60 (described below) of the money handling machine 1, loose coins are fed out from the loose-coins storage unit in the machine of the loose-coins handling assembly 10 and transported to the loose-coins outlet 14.

As shown in FIG. 1, the coin roll handling assembly 20 is disposed to the immediate left of the loose-coins handling assembly 10, and loose coins are sent from the loose-coins handling assembly 10 to the coin roll handling assembly 20. In the coin roll handling assembly 20, the loose coins sent from the loose-coins handling assembly 10 are wrapped into rolls with a wrapping sheet or the like in units of, for example, 50 coins by a wrapping unit (not shown). The wrapped coin rolls are stored, for example, for each denomination, in a plurality of coin roll storage units in a machine of the coin roll handling assembly 20. A coin roll outlet 22 is disposed at the upper portion of the front surface of the coin roll handling assembly 20. When an instruction for dispensing coin rolls is issued to the controller 60 (described below) of the money handling machine 1, coin rolls are fed out from the coin roll storage unit in the machine of the coin roll handling assembly 20, and transported to the coin roll outlet 22.

As shown in FIG. 1, the loose-banknotes handling assembly 30 is disposed to the immediate left of the coin roll handling assembly 20. A loose-banknotes inlet 32 through which loose banknotes are inserted into a machine of the loose-banknotes handling assembly 30 is disposed at the upper portion of the front surface of the loose-banknotes handling assembly 30. A loose-banknotes outlet 34 through which loose banknotes are discharged to the outside of the machine is disposed in the upper surface of the loose-banknotes handling assembly 30. A deposit recognition unit 116 (described below) in the machine of the loose-banknotes handling assembly 30 performs recognition of a denomination, authentication, fitness, new/old, and the like of the loose-banknotes inserted into the loose banknotes inlet 32. Thereafter, the loose banknotes are stored, for example, for each denomination, in a collective banknote storage 140 or the denomination-based banknote storages 142 (described below) in the machine of the loose-banknotes handling assembly 30. When an instruction for dispensing loose banknotes is issued to the controller 60 (described below) of the money handling machine 1, loose banknotes are fed out from the collective banknote storage 140 or each denomination-based banknote storage 142 in the machine of the loose-banknotes handling assembly 30, and transported to the loose-banknotes outlet 34.

The bound-banknotes handling assembly 40 is disposed to the immediate left of the loose-banknotes handling assembly 30, and loose banknotes are sent from the loose-banknotes handling assembly 30 to the bound-banknotes handling assembly 40. In the bound-banknotes handling assembly 40, loose banknotes sent from the loose-banknotes handling assembly 30 are bound with a binding sheet or the like in units of, for example, 100 banknotes by a binding unit (not shown). The obtained bound banknotes are stored, for example, for each denomination, in a plurality of bound-banknotes storage units in a machine of the bound-banknotes handling assembly 40. A bound-banknotes outlet 42 is disposed at the upper portion of the front surface of the bound-banknotes handling assembly 40. When an instruction for dispensing bound banknotes is issued to the controller 60 (described below) of the money handling machine 1, bound banknotes are fed out from the bound-banknotes storage unit in the machine of the bound-banknotes handling assembly 40, and transported to the bound-banknotes outlet 42.

Figure 3:
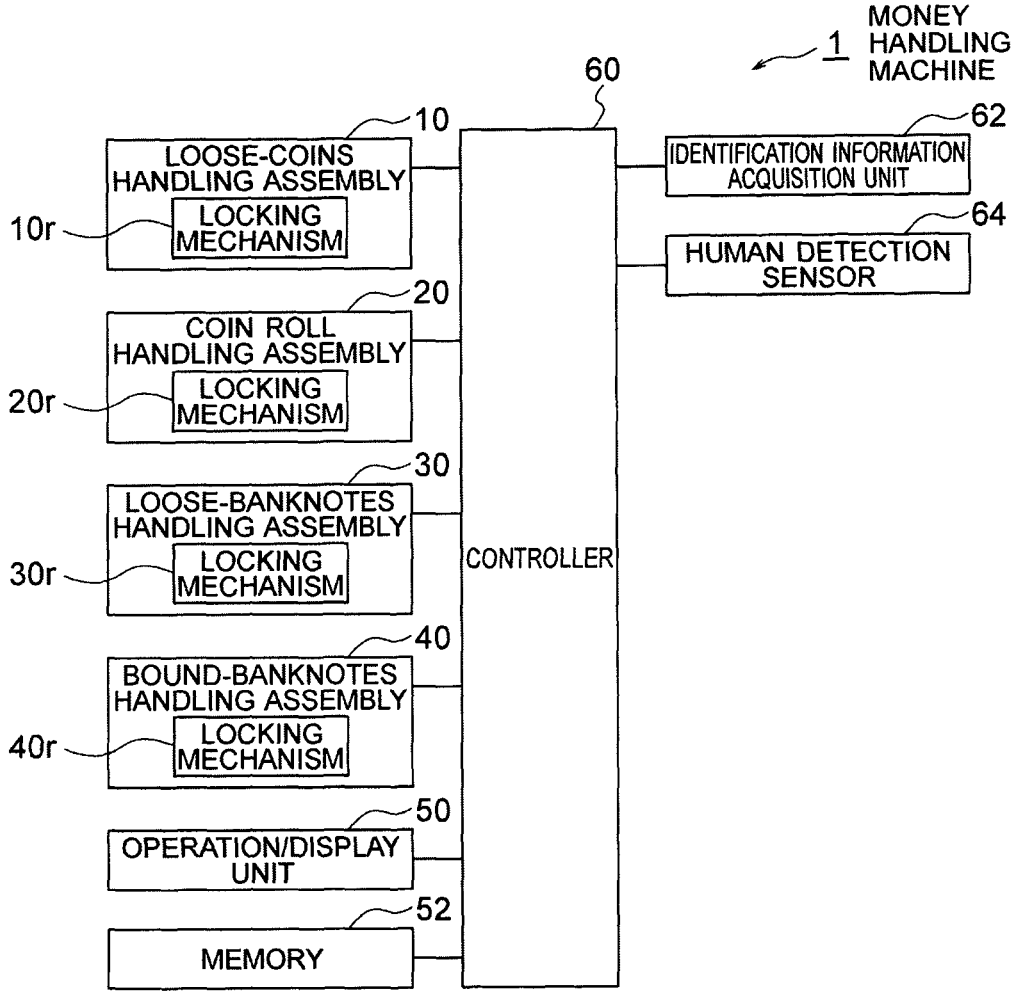
FIG. 3 is a functional block diagram illustrating a configuration of a control system of the money handling machine shown in FIG. 1.

As shown in FIG. 1, the handling assemblies 10, 20, 30, 40 have almost rectangular-parallelepiped-shaped housings 10*a*, 20*a*, 30*a*, 40*a*, respectively. A drawer having a handling unit for handling money (in the description herein, "handling money" includes storing money) such as banknotes and coins is housed in each of the housings 10*a*, 20*a*, 30*a*, 40*a*. Each drawer can be drawn forward from a corresponding one of the housings 10*a*, 20*a*, 30*a*, 40*a*. The drawer having such a configuration will be described below in detail. As shown in FIG. 3, locking mechanisms 10*r*, 20*r*, 30*r*, 40*r* for locking the drawers in the housings 10*a*, 20*a*, 30*a*, 40*a* are disposed in the handling assemblies 10, 20, 30, 40, respectively.

As shown in FIG. 1, an operation/display unit 50 implemented by, for example, a touch panel is disposed on the upper surface of the loose-coins handling assembly 10. On the operation/display unit 50 having such a configuration, for example, information on a state of handling money in the money handling machine 1 and on an inventory amount of money stored in the storage unit of each of the handling assemblies 10, 20, 30, 40, is displayed. An operator is allowed to provide the controller 60 (described below) of the money handling machine 1 with various instructions through the operation/display unit 50.

Next, the configuration of the loose-banknotes handling assembly 30 will be described in detail with reference to FIG. 2.

Figure 2:
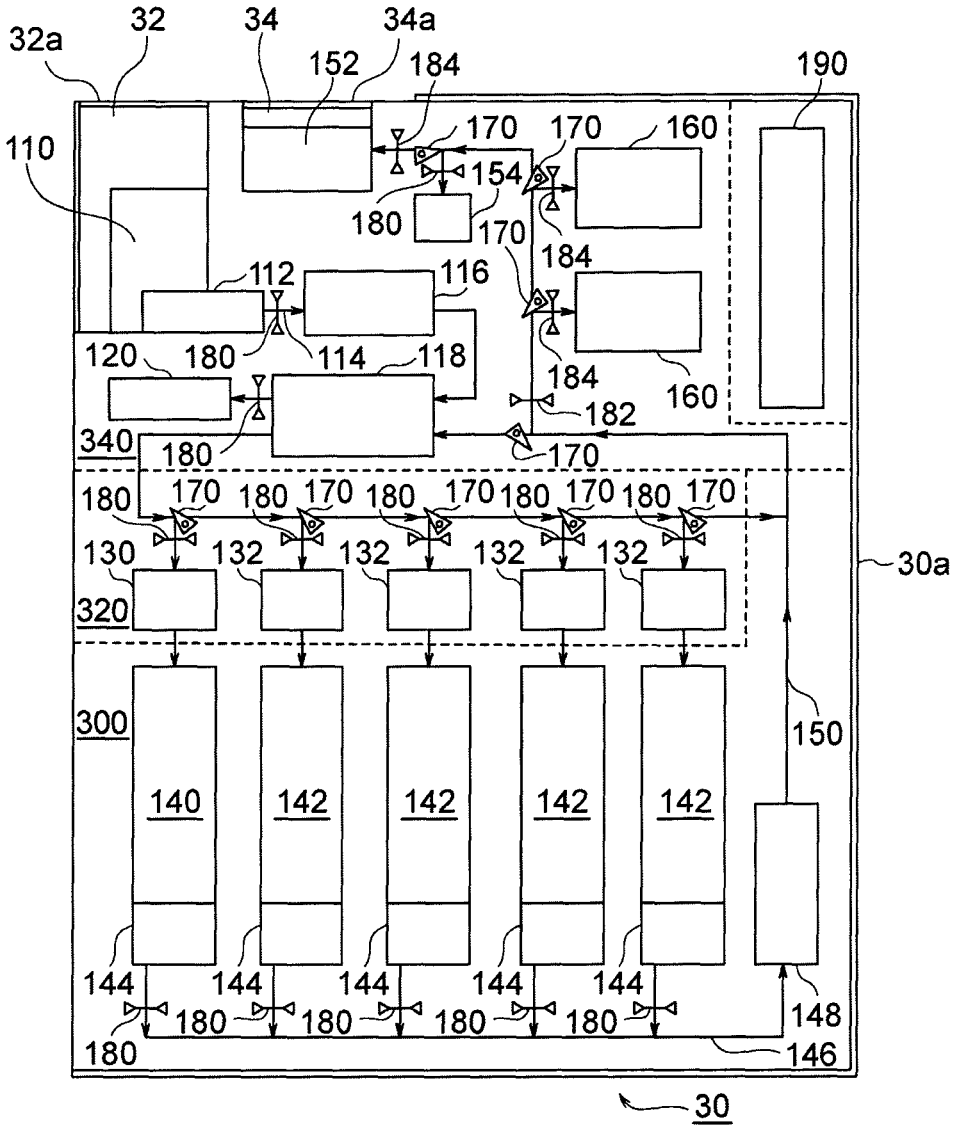
FIG. 2 illustrates a schematic configuration of an internal structure of a loose-banknotes handling assembly in the money handling machine shown in FIG. 1.

As shown in FIG. 2, the loose-banknotes handling assembly 30 has the almost rectangular-parallelepiped-shaped housing 30*a*. The loose-banknotes handling assembly 30 has a banknote inlet unit 110 for feeding out loose banknotes inserted in the loose-banknotes inlet 32 into the housing 30*a*, and a loose-banknotes outlet unit 152 for discharging loose banknotes from the housing 30*a* through the loose-banknotes outlet 34 to the outside. More specifically, the loose-banknotes inlet 32 and the loose-banknotes outlet 34 have shutters 32*a* and 34*a* for opening and closing the banknote inlet unit 110 and the loose-banknotes outlet unit 152, respectively. When the shutter 32*a*, 34*a* is opened, the operator is allowed to set banknotes in the banknote inlet unit 110 through the loose-banknotes inlet 32, or take out banknotes placed in the loose-banknotes outlet unit 152 through the loose-banknotes outlet 34 to the outside. The shutter 32*a* disposed in the loose-banknotes inlet 32 for opening and closing the banknote inlet unit 110 may not be disposed. A banknote feeding unit 112 is disposed in the banknote inlet unit 110, and the banknote feeding unit 112 feeds out banknotes inserted in the banknote inlet unit 110 from the outside, one by one, into the housing 30*a*. A deposit transport unit 114 is connected to the banknote feeding unit 112, and banknotes that are fed out into the housing 30*a* by the banknote feeding unit 112 are transported one by one by the deposit transport unit 114.

As shown in FIG. 2, the deposit recognition unit 116 is disposed in the deposit transport unit 114. The deposit recognition unit 116 performs recognition of a denomination, authentication, fitness, face/back, new/old, a transport state, and the like of a banknote transported by the deposit transport unit 114. A face/back reversing unit 118 is disposed downstream of the deposit recognition unit 116 in the direction of transport of banknotes by the deposit transport unit 114. A banknote recognized by the deposit recognition unit 116 is adjusted by the face/back reversing unit 118 so as to make the face/back appropriate. Specifically, for example, only for a banknote of which the back surface faces upward, among banknotes having been sent to the face/back reversing unit 118, the face/back of the banknote is reversed, so that all the banknotes discharged from the face/back reversing unit 118 have been adjusted such that the upper surface faces upward. A deposit reject unit 120 is connected to the deposit transport unit 114. A banknote which has been recognized as being not a normal banknote by the deposit recognition unit 116, that is, a rejected note, is sent from the deposit transport unit 114 to the deposit reject unit 120. The deposit reject unit 120 can be accessed from the outside of the housing 30*a* of the loose-banknotes handling assembly 30. The operator is allowed to manually take out the rejected banknotes stacked in the deposit reject unit 120.

As shown in FIG. 2, a collective temporary storage unit 130 and a plurality of (for example, four) denomination-based temporary storage units 132 are connected to the deposit transport unit 114. The collective temporary storage unit 130 and the plurality of denomination-based temporary storage units 132 are aligned in parallel. Banknotes transported from the deposit transport unit 114 to the collective temporary storage unit 130 and each denomination-based temporary storage unit 132 are stacked in the collective temporary storage unit 130 and each denomination-based temporary storage unit 132 in a stacked state, and are thus temporarily stored. The collective temporary storage unit 130 temporarily stores banknotes of a plurality of denominations in a mixed state. Banknotes of a specific denomination are temporarily stored in each denomination-based temporary storage unit 132. The collective banknote storage 140 is disposed so as to correspond to the collective temporary storage unit 130, and the plurality of denomination-based banknote storages 142 are disposed so as to correspond to the denomination-based temporary storage units 132, respectively. Banknotes that are sent from the collective temporary storage unit 130 are stored in the collective banknote storage 140 in a stacked state. Banknotes that are sent from a corresponding one of the denomination-based temporary storage units 132 are stored in each denomination-based banknote storage 142 in a stacked state. Banknotes of a plurality of denominations are stored in the collective banknote storage 140 in a mixed state. Banknotes of a specific denomination are stored in each denomination-based banknote storage 142. The collective banknote storage 140 and the denomination-based banknote storages 142 each have a banknote feeding unit 144. Banknotes are fed out from the collective banknote storage 140 and the denomination-based banknote storages 142, one by one, by the banknote feeding units 144. A lower transport unit 146 is connected to each banknote feeding unit 144, and banknotes that are fed out from the collective banknote storage 140 and the denomination-based banknote storages 142 by the banknote feeding units 144 are transported one by one by the lower transport unit 146.

As shown in FIG. 2, a dispensing recognition unit 148 is connected to the lower transport unit 146. The dispensing recognition unit 148 performs recognition of a denomination, authentication, fitness, new/old, and the like of a banknote transported by the lower transport unit 146. The dispensing recognition unit 148 may not perform recognition of authentication and fitness of banknotes. A dispensing transport unit 150 is connected to the dispensing recognition unit 148. The banknotes recognized by the dispensing recognition unit 148 are transported one by one by the dispensing transport unit 150.

As shown in FIG. 2, the loose-banknotes outlet unit 152, a dispensing reject unit 154, and two sorting temporary storage units 160 are connected to the dispensing transport unit 150. Banknotes, among banknotes recognized by the dispensing recognition unit 148, to be discharged to the outside of the housing 30*a* are sent to the loose-banknotes outlet unit 152 by the dispensing transport unit 150, and stacked in the loose-banknotes outlet unit 152. The loose-banknotes outlet unit 152 can be accessed from the outside of the housing 30*a* of the loose-banknotes handling assembly 30. The operator is allowed to manually take out loose banknotes stacked in the loose-banknotes outlet unit 152 through the loose-banknotes outlet 34. A banknote which has been recognized as being not a normal banknote by the dispensing recognition unit 148, that is, a rejected banknote, is sent to the dispensing reject unit 154 by the dispensing transport unit 150. Banknotes, among banknotes recognized by the dispensing recognition unit 148, to be bound as bound banknotes by the bound-banknotes handling assembly 40 arranged in parallel with the loose-banknotes handling assembly 30 are sent to the sorting temporary storage units 160 by the dispensing transport unit 150. Banknotes sent from the dispensing transport unit 150 are stacked in the sorting temporary storage units 160 in a stacked state. A plurality of banknotes stacked in each sorting temporary storage unit 160 are taken out from the sorting temporary storage unit 160 by an arm unit 190, and are transported to the binding unit (not shown) of the bound-banknotes handling assembly 40 by the arm unit 190.

As shown in FIG. 2, banknotes recognized by the dispensing recognition unit 148 can be sent to the face/back reversing unit 118 by the dispensing transport unit 150. Banknotes that are sent to the face/back reversing unit 118 by the dispensing transport unit 150 are transported to the collective temporary storage unit 130 or the denomination-based temporary storage unit 132 by the deposit transport unit 114.

As shown in FIG. 2, diverters 170 are disposed at diverging portions of the deposit transport unit 114 and the dispensing transport unit 150. Destinations of transported banknotes at the diverging portions are determined by the diverters 170. A plurality of banknote detection sensors 180 for detecting banknotes are disposed in the deposit transport unit 114, the lower transport unit 146, and the dispensing transport unit 150. In the present embodiment, a banknote thickness detection sensor 182 and a half note detection sensor 184 are disposed between the dispensing recognition unit 148 and each sorting temporary storage unit 160 in the dispensing transport unit 150. The half note detection sensor 184 is also disposed in the dispensing transport unit 150 that is an inlet portion for the loose-banknotes outlet unit 152.

As shown in FIG. 2, in the loose-banknotes handling assembly 30 of the present embodiment, a lower assembly 300 (drawer) is structured by the collective banknote storage 140, the denomination-based banknote storages 142, the lower transport unit 146, the dispensing recognition unit 148, and the like, and an intermediate assembly 320 (drawer) is structured by the collective temporary storage unit 130 and the four denomination-based temporary storage units 132. The lower assembly 300 and the intermediate assembly 320 can be integrally drawn leftward (forward from the housing 30*a*) in FIG. 2 from the housing 30*a* of the loose-banknotes handling assembly 30. The intermediate assembly 320 alone can be drawn from the housing 30*a*. The lower assembly 300 and the intermediate assembly 320 cannot be completely dismounted from the housing 30*a*. When the collective banknote storage 140, each denomination-based banknote storage 142, and the like have been exposed to the outside, the lower assembly 300 and the intermediate assembly 320 cannot be further drawn from the housing 30*a*.

Figure 5:
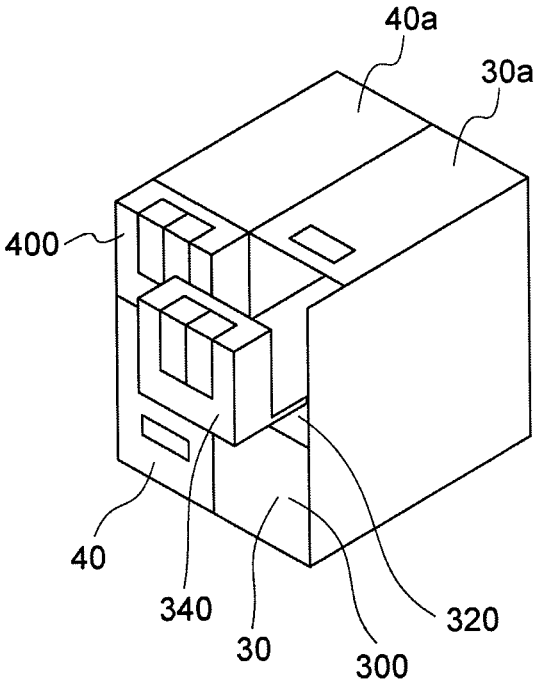
FIG. 5 is a perspective view schematically illustrating a state where the upper assembly is drawn forward from the housing of the loose-banknotes handling assembly in the loose-banknotes handling assembly of the money handling machine shown in FIG. 1.

An upper assembly 340 (drawer) is structured by the banknote inlet unit 110, the deposit transport unit 114, the deposit recognition unit 116, the face/back reversing unit 118, the deposit reject unit 120, the loose-banknotes outlet unit 152, the sorting temporary storage units 160, and the like. The upper assembly 340 is disposed on the lower assembly 300 and the intermediate assembly 320. The upper assembly 340 can be also drawn leftward (forward from the housing 30*a*) in FIG. 2 from the housing 30*a* of the loose-banknotes handling assembly 30. FIG. 5 is a perspective view schematically illustrating a state where the upper assembly 340 is drawn forward from the housing 30*a* of the loose-banknotes handling assembly 30. The upper assembly 340 cannot be completely dismounted from the housing 30*a*, either. When the deposit transport unit 114 and the like have been exposed to the outside, the upper assembly 340 cannot be further drawn from the housing 30*a*.

Figure 4:
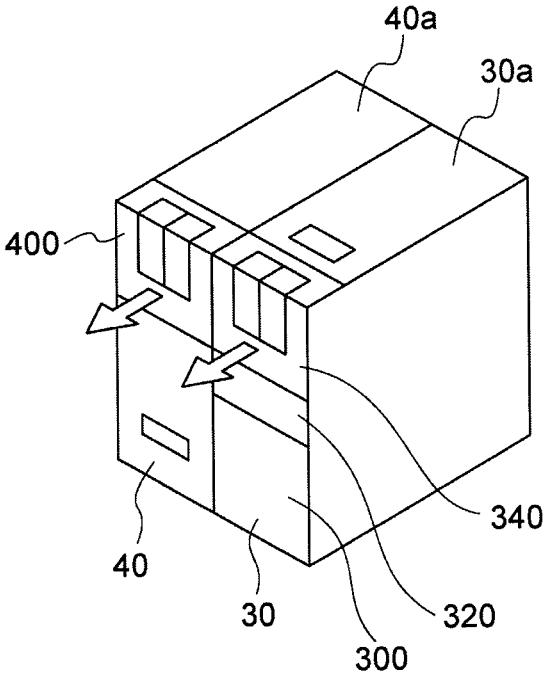
FIG. 4 is a perspective view schematically illustrating a state where an upper assembly has not been drawn forward from a housing of the loose-banknotes handling assembly in the loose-banknotes handling assembly of the money handling machine shown in FIG. 1.

As shown in FIG. 4 and FIG. 5, in the bound-banknotes handling assembly 40 of the present embodiment, a drawer 400 having a handling unit (for example, binding unit) for performing binding of banknotes is housed in the housing 40*a*, and the drawer 400 can be drawn forward from the housing 40*a*. The drawer 400 cannot be completely dismounted from the housing 40*a*. When the handling unit such as the binding unit has been exposed to the outside, the drawer 400 cannot be further drawn from the housing 40*a*. Similarly, in the loose-coins handling assembly 10 and the coin roll handling assembly 20 of the present embodiment, drawers having handling units for handling loose coins and coin rolls are housed in the housings 10*a* and 20*a*, and the drawers can be drawn forward from the housings 10*a* and 20*a*.

Next, the configuration of a control system of the money handling machine 1 as shown in FIG. 1 will be described with reference to FIG. 3. As shown in FIG. 3, the money handling machine 1 includes the controller 60 that controls each of the loose-coins handling assembly 10, the coin roll handling assembly 20, the loose-banknotes handling assembly 30, and the bound-banknotes handling assembly 40. Specifically, each of the handling assemblies 10, 20, 30, 40 is connected to the controller 60, and the controller 60 transmits an instruction signal to each of the handling assemblies 10, 20, 30, 40, to control each of the handling assemblies 10, 20, 30, 40. The operation/display unit 50 is also connected to the controller 60. An instruction inputted to the operation/display unit 50 by the operator is transmitted to the controller 60, and the controller 60 transmits an instruction signal to the operation/display unit 50, to control a content displayed by the operation/display unit 50. A memory 52 is connected to the controller 60. For example, information on history of handling money in each of the handling assemblies 10, 20, 30, 40, and on an inventory amount of money stored in each of the storage units of the handling assemblies 10, 20, 30, 40 is stored in the memory 52. Furthermore, identification information of the authorized operator who is authorized to resolve the error when the error occurs in the money handling machine 1 is stored in the memory 52.

In the present embodiment, an identification information acquisition unit 62 and a human detection sensor 64 are connected to the controller 60. The identification information acquisition unit 62 acquires identification information such as an identification number of the operator who operates the money handling machine 1. Specifically, the identification information acquisition unit 62 has a card reader (not shown) that reads an ID card or the like of the operator, and causes the card reader to read the identification information, for each operator, stored in the ID card, thereby acquiring the identification information of the operator. In another example, for example, an indicator for allowing the operator to input her/his identification number is displayed on the operation/display unit 50, and the identification information acquisition unit 62 may acquire identification information of the operator, based on the identification number of the operator which has been inputted to the operation/display unit 50. In still another example, the identification information acquisition unit 62 may perform biometric authentication for performing authentication of a vein of a finger, a fingerprint, a retina, a face image, or the like in the operator to acquire identification information of the operator. Thus, the identification information acquisition unit 62 that acquires identification information such as an identification number of the operator who operates the money handling machine 1 may be variously structured. The human detection sensor 64 detects whether or not the operator is in front of the money handling machine 1.

Figure 6:
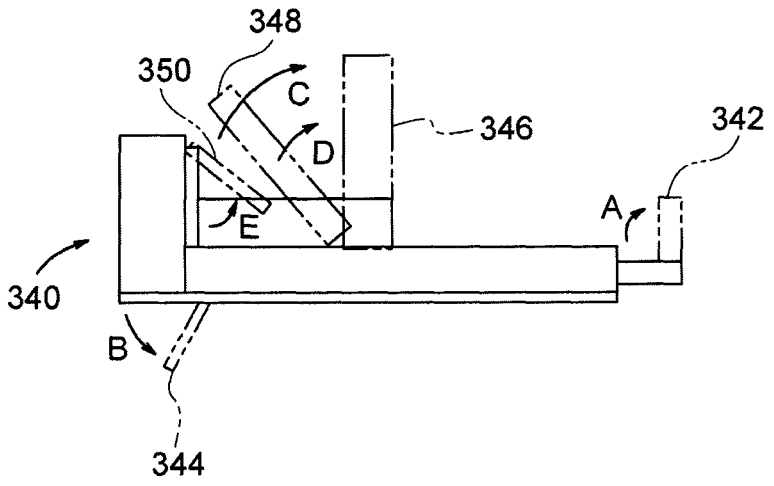
FIG. 6 is a side view schematically illustrating a configuration of the upper assembly which has been drawn forward from the housing of the loose-banknotes handling assembly of the money handling machine shown in FIG. 1.
Figure 7:
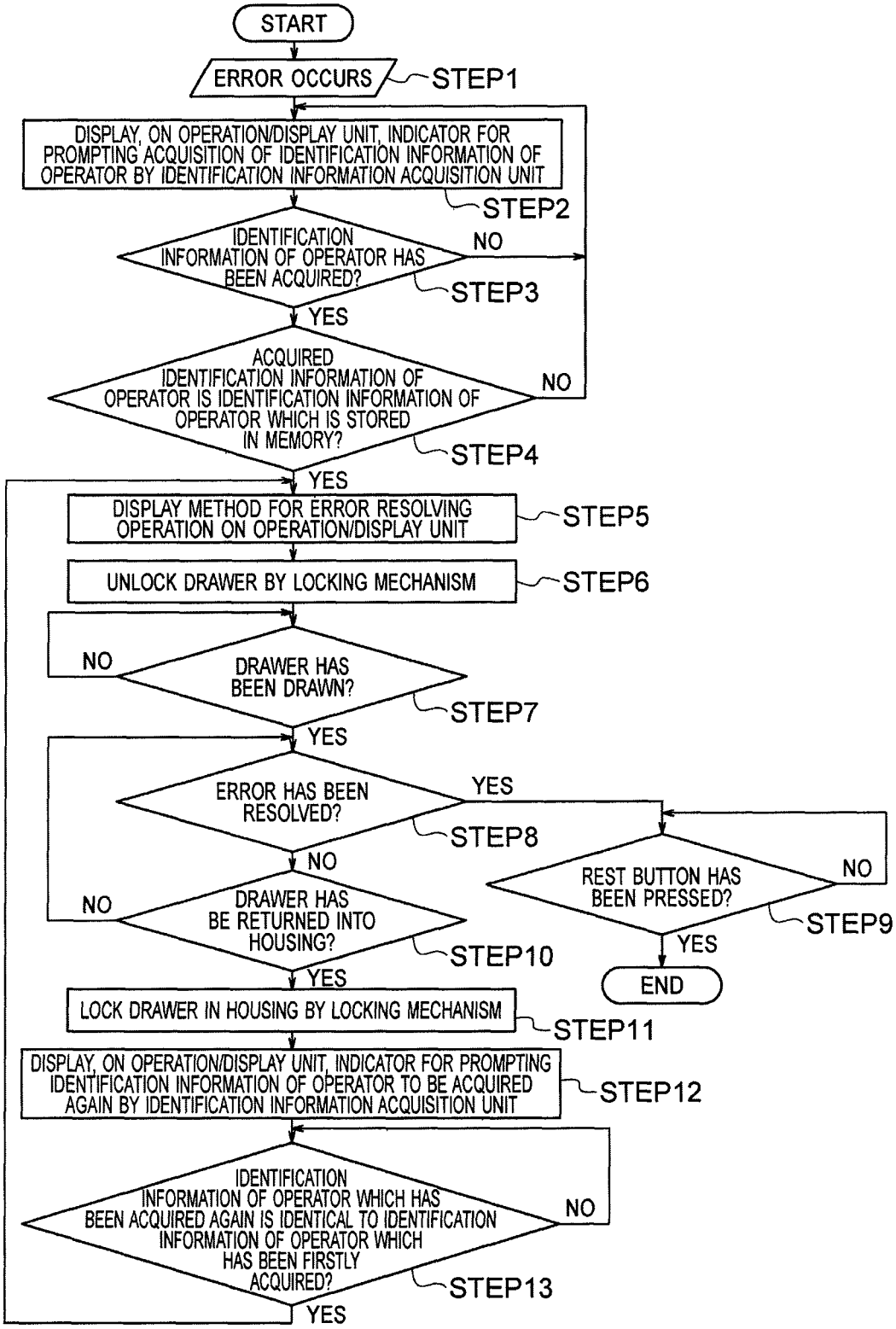
FIG. 7 is a flow chart showing an operation performed for resolving an error when the error occurs in the money handling machine shown in FIG. 1.
Figure 8:
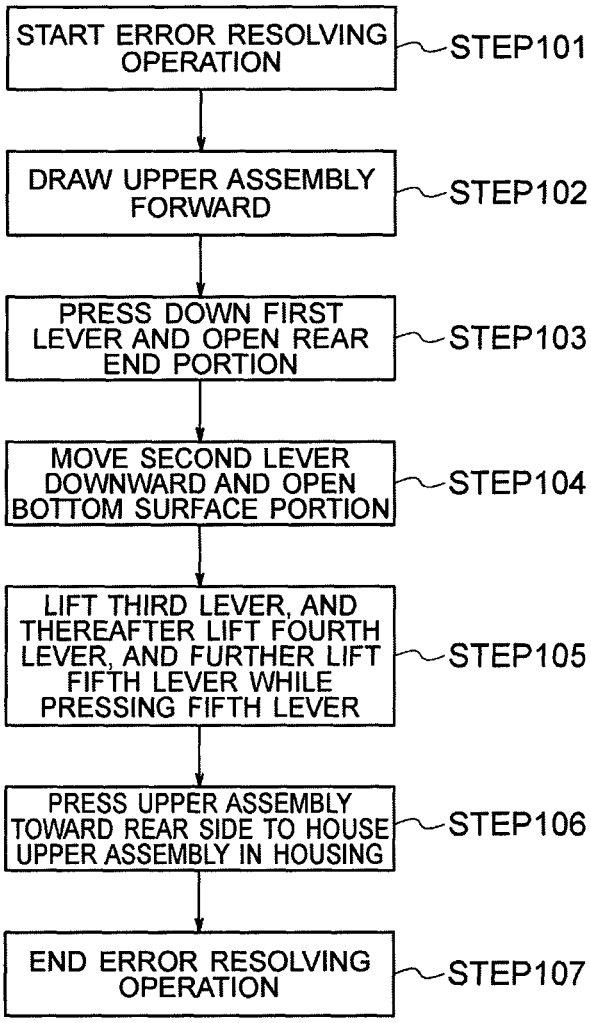
FIG. 8 is a flow chart showing a procedure of an operation performed for resolving the error in the loose-banknotes handling assembly of the money handling machine shown in FIG. 1.

Next, an operation for resolving an error such as jamming of a coin or a banknote when the error occurs in the housing of the handling assembly 10, 20, 30, 40 in the money handling machine 1 having such a configuration will be described by using the loose-banknotes handling assembly 30 as an example with reference to FIG. 4 to FIG. 8. FIG. 4 is a perspective view schematically illustrating a state where the upper assembly 340 has not been drawn forward from the housing 30*a* of the loose-banknotes handling assembly 30 in the loose-banknotes handling assembly 30. FIG. 5 is a perspective view schematically illustrating a state where the upper assembly 340 is drawn forward from the housing 30*a* of the loose-banknotes handling assembly 30 in the loose-banknotes handling assembly 30. FIG. 6 is a side view schematically illustrating the configuration of the upper assembly 340 which has been drawn forward from the housing 30*a* of the loose-banknotes handling assembly 30. FIG. 7 is a flow chart showing an operation performed for resolving the error when the error occurs in the money handling machine 1. FIG. 8 is a flow chart showing a procedure of an operation performed for resolving the error in the loose-banknotes handling assembly 30.

When the error such as jamming of a banknote occurs in the loose-banknotes handling assembly 30 of the money handling machine 1 (STEP1 in the flow chart shown in FIG. 7), an indicator for prompting acquisition of identification information of the operator by the identification information acquisition unit 62 is displayed on the operation/display unit 50 (STEP2). Specifically, when the identification information acquisition unit 62 has a card reader (not shown), a message indicating "Please cause the card reader to read an ID card" is displayed on the operation/display unit 50. Alternatively, an indicator for allowing the operator to input his/her identification number may be displayed on the operation/display unit 50. When the identification information of the operator has been acquired by the identification information acquisition unit 62 ("YES" in STEP3), the controller 60 determines whether or not the acquired identification information of the operator is an identification number of the authorized operator who is authorized to resolve the error, which is stored in the memory 52 (STEP4).

In the present embodiment, only when the identification information of the operator acquired by the identification information acquisition unit 62 is the stored identification number of the operator in the memory 52 ("YES" in STEP4), the operator is allowed to perform an operation for resolving the error that has occurred in the loose-banknotes handling assembly 30 (STEP101 in the flow chart shown in FIG. 8). Specifically, a guidance screen for a method for an error resolving operation is displayed on the operation/display unit 50 (STEP5). The drawer (specifically, for example, the upper assembly 340) is unlocked by the locking mechanism 30*r* (STEP6), and the upper assembly 340 can be drawn forward from the housing 30*a*. When the operator draws the upper assembly 340 forward from the housing 30*a* of the loose-banknotes handling assembly 30 in a state shown in FIG. 4 in the loose-banknotes handling assembly 30, and the state shifts to a state shown in FIG. 5 ("YES" in STEP7 and STEP102), a guidance screen for instructing the operator to press down a first lever (not shown) disposed near the rear end of the upper assembly 340 and open a rear end portion 342 (see FIG. 6) of the upper assembly 340 rearward, is displayed on the operation/display unit 50. As in STEP103 in the flow chart shown in FIG. 8, when the operator presses down the first lever disposed near the rear end of the upper assembly 340 and opens the rear end portion 342 of the upper assembly 340 rearward according to the guidance screen (see reference numeral A in FIG. 6), the operator is allowed to remove a banknote jammed at the deposit transport unit 114 (more specifically, a portion downstream of the deposit recognition unit 116) in the upper assembly 340.

Next, a guidance screen for instructing the operator to press down a second lever (not shown) disposed near the front end portion on the bottom surface of the upper assembly 340 and open a bottom surface portion 344 (see FIG. 6) of the upper assembly 340 downward is displayed on the operation/display unit 50. As in STEP104 in the flow chart shown in FIG. 8, when the operator presses down the second lever disposed near the front end portion on the bottom surface of the upper assembly 340 and opens the bottom surface portion 344 of the upper assembly 340 downward according to the guidance screen (see reference numeral B in FIG. 6), the operator is allowed to remove a banknote jammed between the upper assembly 340 and the intermediate assembly 320 in the deposit transport unit 114.

Thereafter, a guidance screen for instructing the operator to lift a third lever (not shown) disposed on the side portion of a first upper surface portion 346 (see FIG. 6) of the upper assembly 340 and open the first upper surface portion 346 upward is displayed on the operation/display unit 50. The deposit recognition unit 116 is disposed in the first upper surface portion 346. As in STEP105 in the flow chart shown in FIG. 8, when the operator has lifted the third lever disposed on the side portion of the first upper surface portion 346 of the upper assembly 340 and opened the first upper surface portion 346 upward according to the guidance screen (see reference numeral C in FIG. 6), a guidance screen for instructing the operator to lift a fourth lever (not shown) disposed on the side portion of a second upper surface portion 348 (see FIG. 6) of the upper assembly 340 and open the second upper surface portion 348 upward is displayed on the operation/display unit 50. The second upper surface portion 348 is mainly structured by the face/back reversing unit 118. As in STEP105 in the flow chart shown in FIG. 8, when the operator has lifted the fourth lever disposed on the side portion of the second upper surface portion 348 of the upper assembly 340 and opened the second upper surface portion 348 upward according to the guidance screen (see reference numeral D in FIG. 6), a guidance screen for instructing the operator to open a back surface portion 350 upward by lifting a fifth lever (not shown) disposed at an upper portion of the back surface portion 350 (see FIG. 6) of the upper assembly 340 while pressing the fifth lever is displayed on the operation/display unit 50. As in STEP105 in the flow chart shown in FIG. 8, the operator opens the back surface portion 350 upward by lifting the fifth lever disposed at the upper portion of the back surface portion 350 of the upper assembly 340 while pressing the fifth lever, according to the guidance screen (see reference numeral E in FIG. 6). In the present embodiment, by the first upper surface portion 346, the second upper surface portion 348, and the back surface portion 350 being opened in the upper assembly 340, a banknote jammed in the deposit transport unit 114 of the upper assembly 340 can be removed.

When all the operations in STEP103 to STEP105 in the flow chart shown in FIG. 8 have been performed, a guidance screen for instructing the operator to push the upper assembly 340 toward the rear side of the loose-banknotes handling assembly 30 and return the upper assembly 340 into the housing 30*a* of the loose-banknotes handling assembly 30 is displayed on the operation/display unit 50. When the operator has pushed the upper assembly 340 toward the rear side of the loose-banknotes handling assembly 30 to house the upper assembly 340 in the housing 30*a* of the loose-banknotes handling assembly 30 (STEP106), the operation for resolving the error ends (STEP107). Specifically, after the error has been resolved ("YES" in STEP8), when the operator pushes the upper assembly 340 toward the rear side of the loose-banknotes handling assembly 30, to house the upper assembly 340 in the housing 30*a* of the loose-banknotes handling assembly 30, a reset button is displayed on the guidance screen displayed on the operation/display unit 50. When the operator presses the reset button displayed on the operation/display unit 50 ("YES" in STEP9), the operation for resolving the error ends.

Meanwhile, when the error occurs in the money handling machine 1, the upper assembly 340 is drawn forward from the housing 30*a* in order to perform an operation for resolving the error, and the upper assembly 340 may be thereafter returned into the housing 30*a* ("YES" in STEP10) in a state where a banknote that has caused the jamming is not removed (that is, a state where the error has not been resolved) ("NO" in STEP8). For example, when the operator is a clerk of a store, the operator may depart from the money handling machine 1 for dealing with a customer, or the operator may depart from the money handling machine 1 in order to find a manager because a specific method for resolving the error is not clear even when the operator views the guidance screen displayed on the operation/display unit 50. In this case, the operator who has performed the operation for resolving the error pushes the upper assembly 340 toward the rear side of the loose-banknotes handling assembly 30 to temporarily house the upper assembly 340 in the housing 30*a* of the loose-banknotes handling assembly 30 ("YES" in STEP10) in order to prevent a third party from removing a banknote from the upper assembly 340. In the present embodiment, when the upper assembly 340 is thus returned into the housing 30*a*, the upper assembly 340 is locked in the housing 30*a* by the locking mechanism 30*r* even if the error has not been resolved (STEP11). Furthermore, when the upper assembly 340 has been locked in the housing 30*a* by the locking mechanism 30*r*, an indicator for prompting the identification information of the operator to be acquired again by the identification information acquisition unit 62 is displayed on the operation/display unit 50 (STEP12). In a case where the identification information acquisition unit 62 has acquired again the identification information of the operator, only when the acquired identification information of the operator is identical to the identification information of the operator acquired by the identification information acquisition unit 62 for the first time after occurrence of the error ("YES" in STEP13), a guidance screen for the method for the error resolving operation is displayed again on the operation/display unit 50 (STEP5), and the upper assembly 340 is unlocked again by the locking mechanism 30*r* (STEP6). Then, the upper assembly 340 can be drawn forward from the housing 30*a*.

In a conventional money handling machine, a drawer is drawn from a housing when the error has occurred, and, thereafter, if the drawer is returned into the housing in a state where the error has not been resolved, the drawer is not locked in the housing by a locking mechanism. That is, until the error is resolved and a reset button displayed on an operation/display unit is pressed, the drawer is not locked in the housing by the locking mechanism. However, in this case, after the operator departs from the money handling machine, a third party may stand in front of the money handling machine, draw the drawer from the money handling machine, and take out money such as banknotes from the drawer. Therefore, a problem arises that, if the money has been taken from the drawer, error in calculation occurs in the money handling machine. Meanwhile, in the present embodiment, for example, even if the drawer (specifically, for example, the upper assembly 340) is returned into the housing 30*a* in a state where the error has not been resolved in the loose-banknotes handling assembly 30, the upper assembly 340 is locked in the housing 30*a* by the locking mechanism 30*r* although the error has not been resolved. In a case where identification information of the operator has been acquired again by the identification information acquisition unit 62, only when the acquired identification information of the operator is identical to identification information of the operator acquired by the identification information acquisition unit 62 for the first time after occurrence of the error, the upper assembly 340 is unlocked again by the locking mechanism 30*r*. Therefore, even if the operator departs from the money handling machine 1, a third party different from the operator who has firstly performed an operation for resolving the error is prevented from drawing the upper assembly 340 from the housing 30*a*. Thus, such a third party is prevented from taking a banknote from the upper assembly 340.

In the present embodiment, in a case where the drawer (specifically, for example, the upper assembly 340) is returned into the housing 30*a* in a state where the error has not been resolved, the upper assembly 340 is locked in the housing 30*a* by the locking mechanism 30*r*, and, thereafter, the upper assembly 340 is unlocked again by the locking mechanism 30*r* when identification information of the operator acquired again by the identification information acquisition unit 62 is identical to identification information of the operator acquired by the identification information acquisition unit 62 for the first time after occurrence of the error. However, the present embodiment is not limited thereto. In another example, when identification information of the operator acquired again by the identification information acquisition unit 62 is predetermined identification information, the upper assembly 340 may be unlocked by the locking mechanism 30*r* such that the upper assembly 340 can be drawn from the housing 30*a* again. For example, when the upper assembly 340 is returned into the housing 30*a* in a state where the error has not been resolved, instead of a staff member, in charge in a store, who has firstly performed an operation for resolving the error, a manager who is a supervisor of the staff member may continue to perform the operation for resolving the error instead of the staff member. For such a case, when the controller 60 determines that identification information of the operator acquired again by the identification information acquisition unit 62 is stored identification information of the manager in the memory 52, the upper assembly 340 may be unlocked by the locking mechanism 30*r*. In another example, in a case where the upper assembly 340 is returned into the housing 30*a* in a state where the error has not been resolved, when two persons who are a manager and a staff member, in a store, who has firstly performed an operation for resolving the error are identified, the operation for resolving the error may be continued. For such a case, when the controller 60 determines that identification information of two operators acquired again by the identification information acquisition unit 62 matches stored identification information of the staff member and the manager in the memory 52, the upper assembly 340 may be unlocked by the locking mechanism 30*r*.

In the present embodiment, the operation/display unit 50 may operate so as to allow setting of a password (one time password) when the operator departs from the money handling machine 1. In this case, after the upper assembly 340 is returned into the housing 30*a* in a state where the error has not been resolved and the upper assembly 340 is locked in the housing 30*a* by the locking mechanism 30*r*, the upper assembly 340 is not unlocked by the locking mechanism 30*r* until the password having been set is inputted through the operation/display unit 50. Also in this case, while the operator departs from the money handling machine 1, the upper assembly 340 can be prevented from being drawn forward from the housing 30*a* by a third party different from the operator. Therefore, a banknote can be prevented from being taken from the upper assembly 340 by the third party.

When the operator departs from the money handling machine 1, the money handling machine 1 may shift to an absence mode by an absence button displayed on the operation/display unit 50 being pressed by the operator. In this case, information indicating that the money handling machine 1 is in the absence mode is displayed on the operation/display unit 50. Specifically, it is indicated by the operation/display unit 50 that an operation for resolving the error is being performed in the money handling machine 1, and the operator is not near the money handling machine 1. Thus, the money handling machine 1 can be prevented from being erroneously operated by another operator. In still another example, in a case where the error occurs in the handling assembly 10, 20, 30, 40 of the money handling machine 1, if an operation of resolving the error is not performed even when a certain time has passed after identification information of the operator has been acquired by the identification information acquisition unit 62, the money handling machine 1 may shift to the absence mode. In still another example, when the human detection sensor 64 detects that the operator is not in front of the money handling machine 1, the money handling machine 1 may shift to the absence mode. Also in these cases, information indicating that the money handling machine 1 is in the absence mode is displayed on the operation/display unit 50. In a case where the money handling machine 1 is in the absence mode, notification that an operation for resolving the error is being performed in the money handling machine 1 and the operator is not near the money handling machine 1 may be made to an operator by another method (for example, a voice message is outputted by an audio speaker) instead of the operation/display unit 50 indicating that the operation for resolving the error is being performed in the money handling machine 1 and the operator is not near the money handling machine 1.

When the money handling machine 1 is in the absence mode, the mode may shift to an energy saving mode. In such an energy saving mode, when the human detection sensor 64 detects again that the operator is in front of the money handling machine 1, acquisition of identification information of the operator by the identification information acquisition unit 62 is merely allowed. That is, when the identification information acquisition unit 62 has a card reader, the card reader can be merely used. Only when identification information of the operator in an ID card having been read by the card reader is identical to predetermined identification information (for example, identification information of the operator acquired by the identification information acquisition unit 62 for the first time after occurrence of the error, or identification information of the operator's supervisor such as a manager), the money handling machine 1 is returned to a normal mode. Meanwhile, in a case where identification information of the operator in an ID card having been read by the card reader is not the predetermined identification information, the money handling machine 1 is not returned to the normal mode and continues to be in the absence mode.

In the above description, an exemplary case is described in which, if the error occurs in the loose-banknotes handling assembly 30 and the like of the money handling machine 1, the error cannot be resolved until identification information of the operator is acquired by the identification information acquisition unit 62. However, the present embodiment is not limited to such an example. In another example, when the operator performs various operations such as money depositing and dispensing in the money handling machine 1, money may not be handled by the money handling machine 1 unless identification information of the operator is firstly acquired by the identification information acquisition unit 62. Specifically, identification information of the authorized operator who is authorized to handle money in the money handling machine 1 is stored in the memory 52. Before the operator handles money in the money handling machine 1, the identification information acquisition unit 62 is caused to acquire identification information of the operator. If the acquired identification information of the operator is not identical to stored identification information of the operator in the memory 52, the operator is not allowed to perform operation in the money handling machine 1. In this case, when the error occurs (STEP1 in the flow chart shown in FIG. 7), even if an identification number of the operator is not acquired by the identification information acquisition unit 62, a guidance screen for a method for an error resolving operation is displayed on the operation/display unit 50 (STEP5). Furthermore, the drawer (specifically, for example, the upper assembly 340) is unlocked by the locking mechanism 30*r* (STEP 6), and the upper assembly 340 can be drawn forward from the housing 30*a*. Thus, in the recitation of claims that "when the error occurs in a handling unit, a drawer can be drawn from a housing subject to identification information of the operator having been acquired by an identification information acquisition unit", "subject to identification information of the operator having been acquired by an identification information acquisition unit" is not limited to acquisition of identification information of the operator by the identification information acquisition unit 62 after occurrence of the error. The recitation of claims also includes the meaning that identification information of the operator is acquired by the identification information acquisition unit 62 before the operator handles money in the money handling machine 1 (that is, the identification information of the operator has been already acquired by the identification information acquisition unit 62 when the error occurs). Furthermore, in this case, in a case where the drawer (specifically, for example, the upper assembly 340) is returned into the housing 30*a* in a state where the error has not been resolved, the upper assembly 340 is locked in the housing 30*a* by the locking mechanism 30*r*, and, thereafter, the upper assembly 340 is unlocked again by the locking mechanism 30*r* when identification information of the operator acquired again by the identification information acquisition unit 62 is identical to identification information of the operator acquired by the identification information acquisition unit 62 before money is handled by the money handling machine 1.

In the money handling machine 1 having the above-described configuration according to the present embodiment and the money handling method performed by the money handling machine 1, when the error occurs in the handling unit of each handling assembly 10, 20, 30, 40, the controller 60 controls the locking mechanism 10*r*, 20*r*, 30*r*, 40*r* such that the drawer (for example, the upper assembly 340 or the drawer 400) can be drawn from the housing 10*a*, 20*a*, 30*a*, 40*a* subject to identification information of the operator having been acquired by the identification information acquisition unit 62. Thus, when the error occurs in the handling unit, the drawer can be drawn from the housing subject to identification information of the operator having been acquired by the identification information acquisition unit 62, whereby a third party can be prevented from drawing the drawer from the housing without permission, and taking away money from the drawer. More specifically, in a conventional money handling machine, if any person is allowed to draw a drawer from a housing when the error occurs, a third party may draw the drawer from the housing without permission and take away money from the drawer while the operator (for example, a clerk of a store or the like) having the authority to resolve the error departs from the money handling machine. Meanwhile, in the present embodiment, the drawer can be drawn from the housing 10*a*, 20*a*, 30*a*, 40*a* subject to identification information of the operator having been acquired by the identification information acquisition unit 62. Therefore, such a problem of the conventional money handling machine can be solved.

In the money handling machine 1 according to the present embodiment and the money handling method performed by the money handling machine 1, as described above, the memory 52 stores identification information of the authorized operator who is authorized to resolve the error, and, if the error occurs in the handling unit, the controller 60 controls the locking mechanism 10*r*, 20*r*, 30*r*, 40*r* such that the drawer can be drawn from the housing 10*a*, 20*a*, 30*a*, 40*a* only when identification information of the operator acquired by the identification information acquisition unit 62 matches stored identification information of the operator in the memory 52. In this case, only the authorized operator who is authorized to resolve the error and who has identification information stored previously in the memory 52 is allowed to draw the drawer from the housing 10*a*, 20*a*, 30*a*, 40*a*. Therefore, a third party is prevented, with enhanced assuredness, from drawing the drawer from the housing 10*a*, 20*a*, 30*a*, 40*a* without permission and taking away money from the drawer.

In the money handling machine 1 according to the present embodiment and the money handling method performed by the money handling machine 1, as described above, in a case where the drawer is returned into the housing 10*a*, 20*a*, 30*a*, 40*a* before resolving of the error that has occurred in the handling unit is completed, the controller 60 controls the locking mechanism 10*r*, 20*r*, 30*r*, 40*r* such that the drawer can be drawn again from the housing 10*a*, 20*a*, 30*a*, 40*a* only when predetermined identification information is acquired by the identification information acquisition unit 62. In this case, in a case where the drawer is drawn from the housing 10*a*, 20*a*, 30*a*, 40*a* when the error occurs, and the drawer is thereafter returned into the housing 10*a*, 20*a*, 30*a*, 40*a* in a state where the error has not been resolved since the operator departs from the money handling machine 1, the drawer is locked in the housing 10*a*, 20*a*, 30*a*, 40*a* by the locking mechanism 10*r*, 20*r*, 30*r*, 40*r*. Therefore, a third party standing in front of the money handling machine 1 can be prevented from drawing the drawer from the money handling machine 1, and taking away money from the drawer after the operator departs from the money handling machine 1. In the present embodiment, in a case where identification information of the operator has been acquired again by the identification information acquisition unit 62, only when the acquired identification information of the operator is identical to identification information of the operator acquired by the identification information acquisition unit 62 for the first time after occurrence of the error, the drawer may be unlocked again by the locking mechanism 10*r*, 20*r*, 30*r*, 40*r*. In this case, the drawer can be prevented from being drawn from the housing 10*a*, 20*a*, 30*a*, 40*a* by a person different from the operator who has firstly performed an operation for resolving the error even if the operator departs from the money handling machine. Therefore, money can be prevented from being taken from the drawer by a person different from the operator who has firstly performed an operation for resolving the error.

The money handling machine according to the present invention and the money handling method performed by the money handling machine, are not limited to the above-described ones, and various modifications can be devised.

For example, the money handling machine according to the present invention is not limited to a handling machine disposed in a back office region of a store. As the money handling machine according to the present invention, a register system having a money change machine and a POS register as shown in FIG. 9 may be used.

Figure 9:
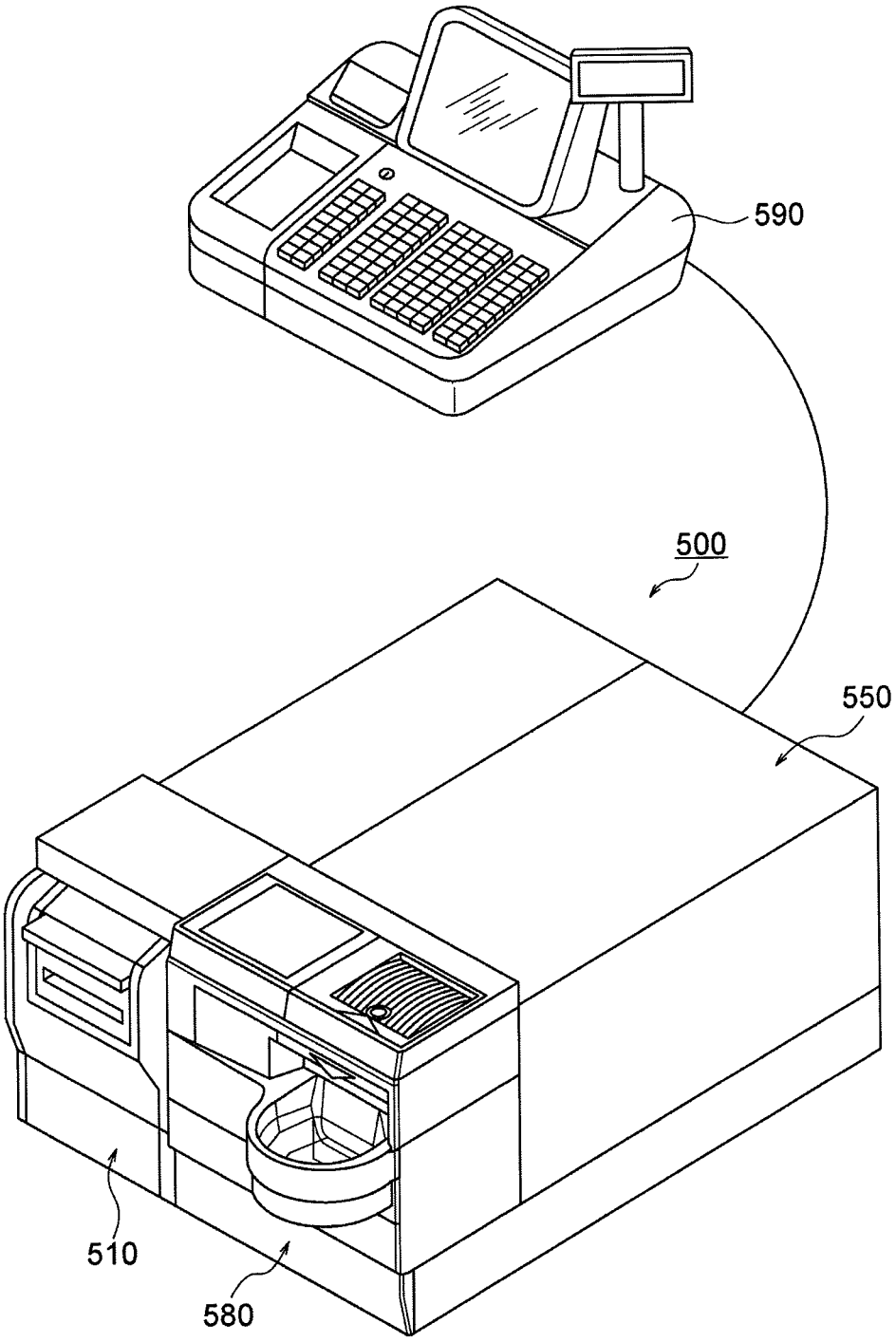
FIG. 9 is a perspective view of an outer appearance of a money handling machine (specifically, register system) as another configuration of the present invention.

A register system 500 as shown in FIG. 9 is disposed in a settlement place in a front office region of a store, in commercial facilities, such as a convenience store and a supermarket. As shown in FIG. 9, the register system 500 includes a coin handling assembly 550 and a coin roll storage assembly 580 that are aligned in the up-down direction, and a banknote handling assembly 510 disposed so as to be aligned next to the coin handling assembly 550 and the coin roll storage assembly 580. A POS register 590 is disposed on the banknote handling assembly 510 and the coin handling assembly 550. The banknote handling assembly 510 and the coin handling assembly 550 perform depositing and dispensing of banknotes and coins, respectively. The coin roll storage assembly 580 stores coin rolls of each denomination so as to allow the coin rolls to be taken out.

The money change machine is structured by the banknote handling assembly 510, the coin handling assembly 550, and the coin roll storage assembly 580. The POS register 590 is used as a management device for managing the money change machine.

In the register system 500 having such a configuration, each of the banknote handling assembly 510, the coin handling assembly 550, and the coin roll storage assembly 580 has a housing and a handling unit that handles money (in the description herein "handling money" includes storing money), and has a drawer that can be drawn forward from the housing, and a locking mechanism that locks the drawer in the housing. An identification information acquisition unit for acquiring identification information of the operator is disposed in the money change machine or the POS register 590. In the register system 500 as shown in FIG. 9, when the error occurs in the handling unit of the banknote handling assembly 510, the coin handling assembly 550, or the coin roll storage assembly 580, the locking mechanism is controlled such that the drawer can be drawn from the housing subject to identification information of the operator having been acquired by the identification information acquisition unit. A controller for controlling such a locking mechanism is disposed in the money change machine or the POS register 590. In the register system 500 having such a configuration, when the error occurs in the handling unit of the banknote handling assembly 510, the coin handling assembly 550, or the coin roll storage assembly 580, the drawer of the banknote handling assembly 510, the coin handling assembly 550, or the coin roll storage assembly 580 can be drawn from the housing subject to identification information of the operator having been acquired by the identification information acquisition unit, whereby a third party can be prevented from drawing the drawer from the housing without permission and taking away money from the drawer.

In the register system 500 as shown in FIG. 9, a memory for storing identification information of the authorized operator who is authorized to resolve the error is disposed in the money change machine or the POS register 590. If the error occurs in the handling unit, the controller controls the locking mechanism such that the drawer of the banknote handling assembly 510, the coin handling assembly 550, or the coin roll storage assembly 580 can be drawn from the housing only when identification information of the operator acquired by the identification information acquisition unit matches stored identification information of the operator in the memory.

In the register system 500 as shown in FIG. 9, when the drawer is returned into the housing before resolving of the error which has occurred in the handling unit is completed, the controller controls the locking mechanism such that the drawer can be drawn again from the housing only when predetermined identification information has been acquired by the identification information acquisition unit. The predetermined identification information may be identification information of the operator acquired by the identification information acquisition unit for the first time after occurrence of the error in the handling unit, or other information (for example, identification information of a manager who is a supervisor of the operator).

The invention claimed is:

1. A money handling machine comprising:

a housing;

a drawer configured to have a handling unit for handling money, and configured to be drawable from the housing;

a locking mechanism arranged within the housing and configured to lock the drawer in the housing;

a display unit;

an identification information acquisition unit configured to acquire identification information of an operator; and a controller configured to control the locking mechanism such that, when an error occurs in the handling unit, the drawer can be drawn from the housing subject to the identification information being acquired, wherein the controller controls the locking mechanism such that, if the drawer has been returned into the housing before resolving of the error occurring in the handling unit is completed, the drawer is locked in the housing, and the drawer is unlocked to be drawn again from the housing only when predetermined identification information has been acquired by the identification information acquisition unit, and when the drawer is locked in the housing, an indicator for prompting the identification information of the operator to be acquired again by the identification information acquisition unit is displayed on the display unit, thereafter, in a case where the identification information acquisition unit acquires again the identification information of the operator, and only when the acquired identification information of the operator is identical to the identification information of the operator acquired by the identification information acquisition unit for a first time after occurrence of the error, a guidance screen for a method for an error resolving operation is displayed on the display unit, and thereafter, the drawer is unlocked again by the locking mechanism.

2. The money handling machine according to claim 1, further comprising a memory configured to store identification information of an authorized operator who is authorized to resolve the error as stored identification information, wherein the controller controls the locking mechanism such that, when the error occurs in the handling unit, the drawer can be drawn from the housing only when acquired identification information by the identification information acquisition unit matches the stored identification information in the memory.

3. The money handling machine according to claim 1, wherein the predetermined identification information is the identification information of the operator acquired by the identification information acquisition unit for the first time after the occurrence of the error in the handling unit.

4. The money handling machine according to claim 1, wherein the display unit displays the indicator for prompting acquisition of the identification information of the operator by the identification information acquisition unit when the error has occurred in the handling unit.

5. The money handling machine according to claim 4, wherein, when the drawer has been returned into the housing before resolving of the error occurring in the handling unit is completed, the display unit displays the indicator for prompting identification information of the operator to be acquired again by the identification information acquisition unit.

6. The money handling machine according to claim 1, further comprising a human detection unit configured to detect whether or not the operator is near the housing.

7. The money handling machine according to claim 6, wherein, if the error occurs in the handling unit and the human detection unit detects that the operator is not near the housing, the controller causes the identification information acquisition unit to acquire identification information of the operator when the human detection unit detects that the operator is again near the housing until resolving of the error occurring in the handling unit is completed.

8. The money handling machine according to claim 6, further comprising a notification unit configured to provide notification that the operator is not near the housing if the human detection unit detects that the operator is not near the housing when the error has occurred in the handling unit.

9. A money handling method performed by a money handling machine comprising a drawer configured to have a handling unit for handling money, and configured to be drawable from a housing, and an identification information acquisition unit configured to acquire identification information of an operator, the money handling method comprising:

locking the drawer in the housing; and causing the drawer to be drawable from the housing subject to the identification information being acquired when an error occurs in the handling unit, wherein if the drawer has been returned into the housing before resolving of the error occurring in the handling unit is completed, the drawer is locked in the housing, and the drawer is unlocked to be drawn again from the housing only when predetermined identification information has been acquired by the identification information acquisition unit, and when the drawer is locked in the housing, an indicator for prompting the identification information of the operator to be acquired again by the identification information acquisition unit is displayed on a display unit, thereafter, in a case where the identification information acquisition unit acquires again the identification information of the operator, and only when the acquired identification information of the operator is identical to the identification information of the operator acquired by the identification information acquisition unit for a first time after occurrence of the error, a guidance screen for the method for the error resolving operation is displayed on the display unit, and thereafter, the drawer is unlocked again by the locking mechanism.

10. The money handling method according to claim 9, further comprising storing, in a memory, identification information of an authorized operator who is authorized to resolve the error as stored identification information, wherein the drawer can be drawn from the housing only when acquired identification information by the identification information acquisition unit matches the stored identification information in the memory when the error occurs in the handling unit.

11. The money handling machine according to claim 2, wherein the display unit displays the indicator for prompting acquisition of the identification information of the operator by the identification information acquisition unit when the error has occurred in the handling unit.

12. The money handling machine according to claim 3, wherein the display unit displays the indicator for prompting acquisition of the identification information of the operator by the identification information acquisition unit when the error has occurred in the handling unit.

13. The money handling machine according to claim 2, further comprising a human detection unit configured to detect whether or not the operator is near the housing.

14. The money handling machine according to claim 7, further comprising a notification unit configured to provide notification that the operator is not near the housing if the human detection unit detects that the operator is not near the housing when the error has occurred in the handling unit.

15. A money handling machine comprising:

a housing;

a drawer configured to have a handling unit for handling money, and configured to be drawable from the housing;

a locking mechanism arranged within the housing and configured to lock the drawer in the housing;

a display unit;

an identification information acquisition unit configured to acquire identification information of an operator; and a controller configured to control the locking mechanism such that, when a particular status occurs in the handling unit, the drawer can be drawn from the housing subject to the identification information being acquired, wherein the controller controls the locking mechanism such that, if the drawer has been returned into the housing before resolving of the particular status occurring in the handling unit is completed, the drawer is locked in the housing, and the drawer is unlocked and can be drawn again from the housing only when predetermined identification information has been acquired by the identification information acquisition unit, and when the drawer is locked in the housing, an indicator for prompting the identification information of the operator to be acquired again by the identification information acquisition unit is displayed on the display unit, thereafter, in a case where the identification information acquisition unit acquires again the identification information of the operator, and only when the acquired identification information of the operator is identical to the identification information of the operator acquired by the identification information acquisition unit for a first time after occurrence of the particular status, a guidance screen for a method for a particular status resolving operation is displayed on the display unit, and thereafter, the drawer is unlocked again by the locking mechanism.

* * * * *